US009675139B2

(12) United States Patent
Shelley

(10) Patent No.: US 9,675,139 B2
(45) Date of Patent: Jun. 13, 2017

(54) DEVICE AND METHODOLOGY FOR ADJUSTING CYCLING CLEATS TO CREATE NEUTRAL ANGULAR DISPLACEMENT

(71) Applicant: Mark A. Shelley, Holden, MA (US)

(72) Inventor: Mark A. Shelley, Holden, MA (US)

( * ) Notice: Subject to any disclaimer, the term of this patent is extended or adjusted under 35 U.S.C. 154(b) by 490 days.

(21) Appl. No.: 13/887,274

(22) Filed: May 3, 2013

(65) Prior Publication Data

US 2014/0026334 A1 Jan. 30, 2014

Related U.S. Application Data

(60) Provisional application No. 61/642,274, filed on May 3, 2012.

(51) Int. Cl.

| | |
|---|---|
| ***A43D 5/00*** | (2006.01) |
| ***A43B 5/14*** | (2006.01) |
| ***A43D 1/08*** | (2006.01) |

(52) U.S. Cl.

CPC ..... *A43D 5/00* (2013.01); *A43B 5/14* (2013.01); *A43D 1/08* (2013.01)

(58) Field of Classification Search

CPC . A43D 5/00; A43D 1/08; A43D 10/02; A43B 5/15; A43B 5/14; A43C 15/02; A43C 15/161; A43C 15/16

USPC ..... 12/103, 123, 122; 36/131, 134, 52; 33/1 N, 471, 515; 74/594.4

See application file for complete search history.

(56) References Cited

U.S. PATENT DOCUMENTS

| | | | |
|---|---|---|---|
| 7,571,544 | B2 | 8/2009 | Champoux et al. |
| 2011/0023244 | A1 | 2/2011 | Hogg |
| 2011/0048166 | A1 | 3/2011 | Lin |

OTHER PUBLICATIONS

Farrell, William L., The Fit Kit Master Manual, Series 2.5., Copyright Apr. 1994.*

RAD Kit, Rotational Adjustment Devices; www.bikefitkit.com/fit_kit/rad_kit; Feb. 29, 2012, 2 pages.

1-RAD Kit, Rotational Adjustment Devices; www.bikefitkit.com/catalog/product_info.php/products_id/30; Feb. 29, 2012; 2 pages.

KEO Fit Technology; www.lookcycle.com/en/all/look-cycle/technologies/techno-keo-fit; Feb. 29, 2012; 2 pages.

* cited by examiner

*Primary Examiner* — Anna Kinsaul
*Assistant Examiner* — Heather Mangine
(74) *Attorney, Agent, or Firm* — John A. Fortkort; Fortkort & Houston PC

(57) ABSTRACT

A tool (401) is provided for adjusting the orientation of cycling cleats on cycling shoes (503). The tool includes a radius (415) having a first protrusion (405) extending therefrom; a pedal adapter (411) which is disposed on a first major surface of the radius and which releasably engages a pedal on a bicycle or cycling machine; a cleat adapter (423), disposed on a second major surface of the radius, which releasably engages a cleat on a cycling shoe and which is rotatably adjustable with respect to the radius; a second protrusion (407) which protrudes from the radius and which overlaps the first protrusion; and a handle (409) which protrudes from the cleat adapter.

15 Claims, 27 Drawing Sheets

DEVICE AND METHODOLOGY FOR ADJUSTING CYCLING CLEATS TO CREATE NEUTRAL ANGULAR DISPLACEMENT

CROSS-REFERENCE TO RELATED APPLICATION

This application claims the benefit of U.S. Provisional Application No. 61/642,274, filed May 3, 2012, having the same title, and having the same inventor, and which is incorporated herein by reference in its entirety.

FIELD OF THE DISCLOSURE

The present application relates generally to cycling cleats, and more particularly to tools for adjusting cleats to the natural gait of a user.

BACKGROUND OF THE DISCLOSURE

Various cycling cleats are known to the art. Cleats are used in conjunction with quill-type pedals to improve the efficiency of the pedal system, so that more of the energy being expended by the cyclist is used to propel the bicycle forward. Typically, a cleat consists of a small, slotted metal or plastic component which attaches on one side to the cyclist's shoe, and which attaches on the other side to the quill section of a bicycle pedal.

Due to the advantages that cleats provide, quill-type pedals are the pedals of choice for competitive cyclists. However, the use of these pedals has become more widespread even among casual cyclists. At present, many cycling machines (of the type found in gyms and other exercise facilities) are now equipped with quill-type pedals.

SUMMARY OF THE DISCLOSURE

Figure 8:
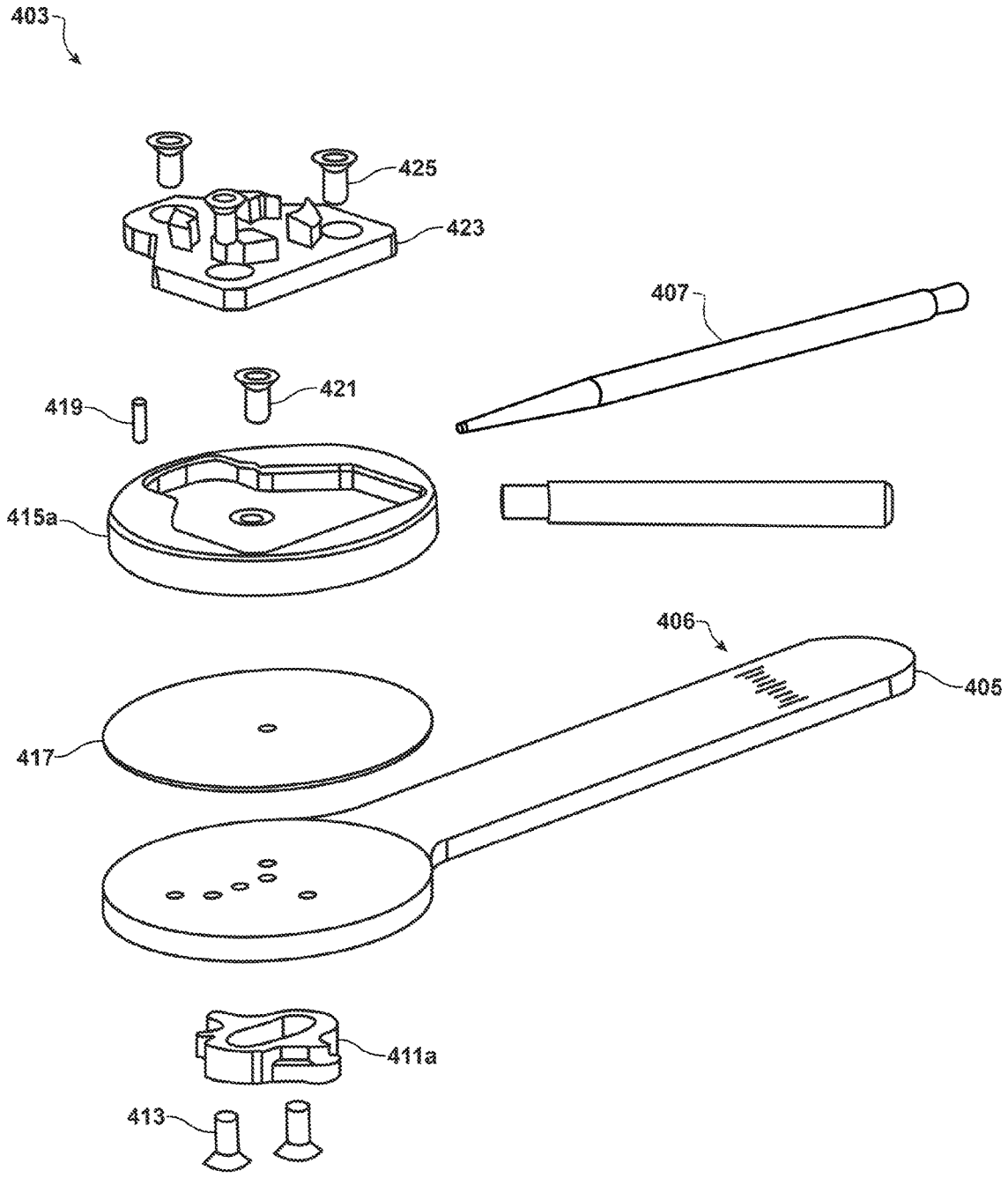
FIG. 8 is an exploded view of a first embodiment of a cycling cleat adjustment tool in accordance with the teachings herein.

In one aspect, a tool is provided for adjusting the orientation of cycling cleats on cycling shoes. The tool comprises (a) a base plate having a rounded portion with a first protrusion extending therefrom (as shown in FIG. 8); (b) a pedal adapter which is disposed on a first major surface of said radius and which releasably engages a pedal on a bicycle or cycling machine; (c) a cleat adapter, disposed on a second major surface of said radius, which releasably engages a cleat on a cycling shoe and which is rotatably adjustable with respect to said radius; (d) a second protrusion which protrudes from said cleat adapter and which overlaps said first protrusion; and (e) a handle which protrudes from said cleat adapter.

In another aspect, a tool is provided for adjusting the orientation of cycling cleats on cycling shoes. The tool comprises (a) a base plate having a rounded portion with a first protrusion extending therefrom, said first protrusion having indicia disposed on a major surface thereof; (b) a pedal adapter which is disposed on a first major surface of said rounded portion and which releasably engages a pedal on a bicycle or cycling machine; (c) a cleat adapter, disposed on a second major surface of said rounded portion, which releasably engages a cleat on a cycling shoe and which is rotatably adjustable with respect to said base plate by way of a handle which extends from said cleat adapter; and (d) a pointer which protrudes from said cleat adapter and which overlaps said first protrusion, wherein the relative position of the pointer with respect to the indicia indicates the current orientation of the cleat adapter.

In a further aspect, a method is provided for adjusting the orientation of a cleat on a cycling shoe. The method comprises providing a tool comprising (a) a base plate having a rounded portion with a first protrusion extending therefrom, (b) a pedal adapter which is disposed on a first major surface of said base plate and which releasably engages a pedal on a bicycle or cycling machine, (c) a cleat adapter, disposed on a second major surface of said base plate, which releasably engages a cleat on a cycling shoe and which is rotatably adjustable with respect to said base plate, (d) a second protrusion which protrudes from said cleat adapter and which overlaps said first protrusion, and (e) a handle which protrudes from said cleat adapter. The pedal adapter of the tool is releasably attached to the pedal of a device selected from the group consisting of bicycles and cycling machines, and the cleat adapter is releasably attached to a cleat which is loosely attached to the shoe of a cyclist. The cyclist is then required to pedal the device for a first duration of time. After the first duration of time, the position of the second protrusion is compared to the position of the first protrusion. If the second protrusion is not centered on the first protrusion, then the rounded portion is manipulated with the handle until the second protrusion is centered on the first protrusion. The cleat is then tightened.

DETAILED DESCRIPTION

Although the use of quill-type pedals has many advantages, the use of these pedal systems also has some distinct disadvantages. In particular, it is important that the cleats used in conjunction with a quill-type pedal are properly aligned to the pedal for the gait of the particular user, since otherwise, use of the cleats may result in equipment induced injuries to the user.

In the past, cleat alignment was frequently a trial and error process, in which the cleats were first set in a default orientation (typically parallel to the chain ring) and then adjusted as necessary to improve user comfort. This approach is undesirable in that it is time consuming and may require several adjustments. Moreover, the success of this approach is predicated on accurate feedback from the user.

Figure 1:
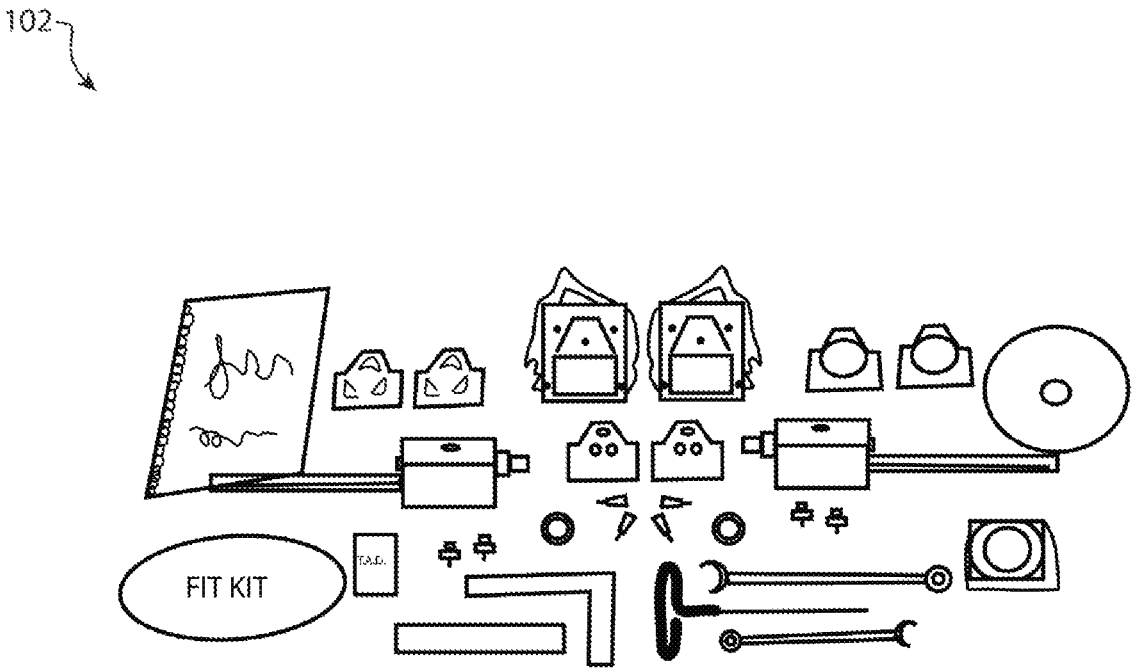
FIGS. 1-2 are illustrations of a first prior art system for cleat adjustment.
Figure 2:
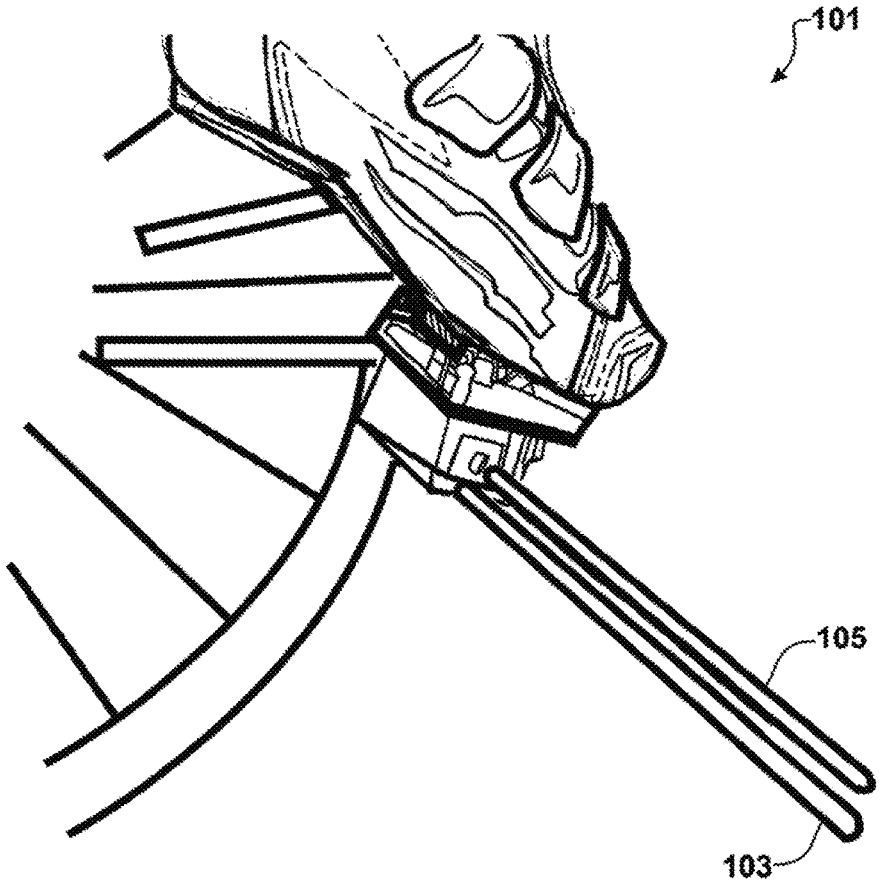

More recently, devices have been developed in the art to take some of the guess work out of cleat adjustment. For example, RAD KIT™ rotational adjustment device produced by Fit Kit Systems, Inc. (Billings, Montana) is a device that allows for cleat adjustment while the cleats are in use. This device 101, which is shown in FIGS. 1-2 and which is frequently sold as part of a kit 102 (see FIG. 1), takes the form of a special pedal that is temporarily installed in place of the bicycle's pedals, and is normally used while the cyclist is riding the bicycle on a wind-load simulator. The device 101 features red 103 and white 105 determinant bars. The red bar 103 is aligned with the axis of the cleat, and thus indicates the position of the lower leg of the cyclist, and the white bar 105 is aligned with the axis of the pedal spindle, and thus indicates the pedal position.

The movement of the red 103 and white 105 bars gives the fit technician a visual comparison of the movement between the cleat and the stable position of the pedal. Since the axis of the pedal remains stationary, the axis of the cleat will move with respect to the axis of the pedal, thus causing the red bar 103 to fluctuate in front of or behind the white bar 105 in response to the rotation of the lower leg.

When the technician adjusts the cleat axis (as indicated by the red determinate bar 103) to match the position of the pedal axis (as indicated by the white determinate bar 105), the position of the rider's natural movement of the foot is purportedly achieved, and the red 103 and white 105 bars line up. The foregoing process is said to secure the cleat in the rider's unique natural movement or natural gait, which is said to help eliminate "equipment induced stress" on the knee, hip and ankle and allow for safe entry and exit in the pedal.

While the foregoing device and associated methodology may have some desirable features, they also suffer from some infirmities. For example, while this device can indicate when alignment has been achieved between the cleat orientation and the user's natural gait, it does not provide an angular measurement of the cleat adjustment needed to correct for the user's gait. Moreover, the use of this device requires tools for its attachment and removal, and further requires the existing pedals of the bicycle to be replaced, and then reinstalled, after cleat adjustment is completed. Furthermore, this device requires the user's shoe to be removed from the device for cleat adjustment.

Figure 3:
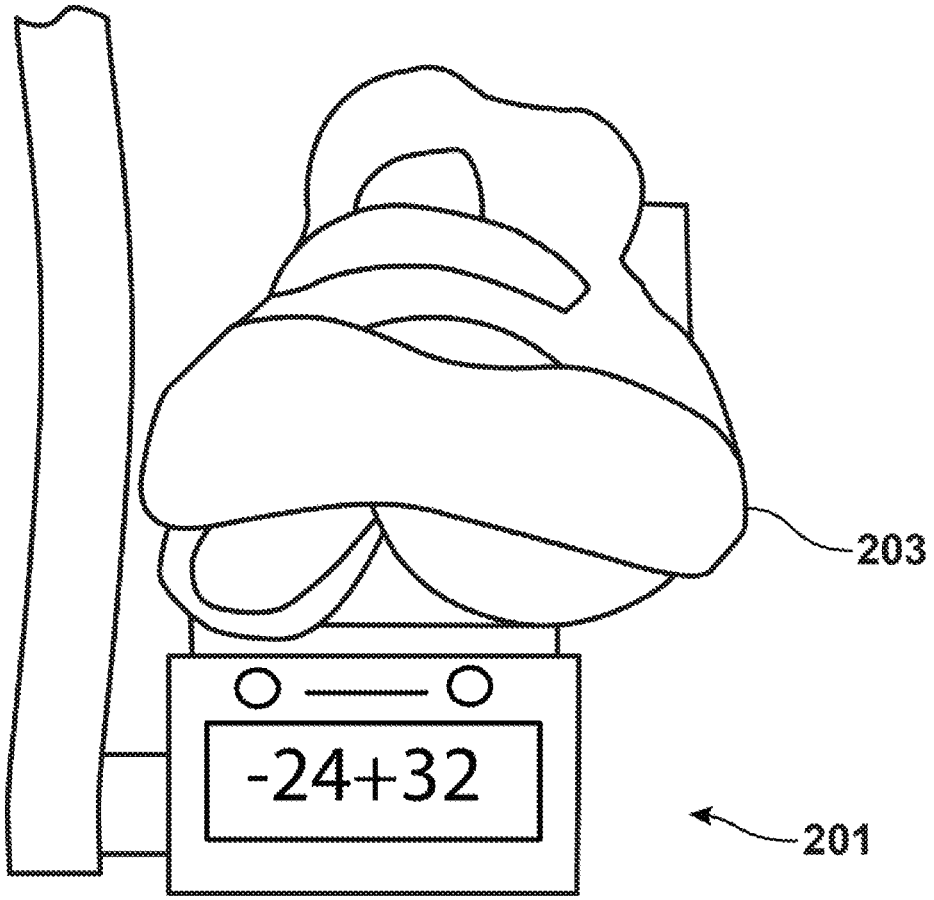
FIGS. 3-5 are illustrations of a second prior art system for cleat adjustment.
Figure 4:
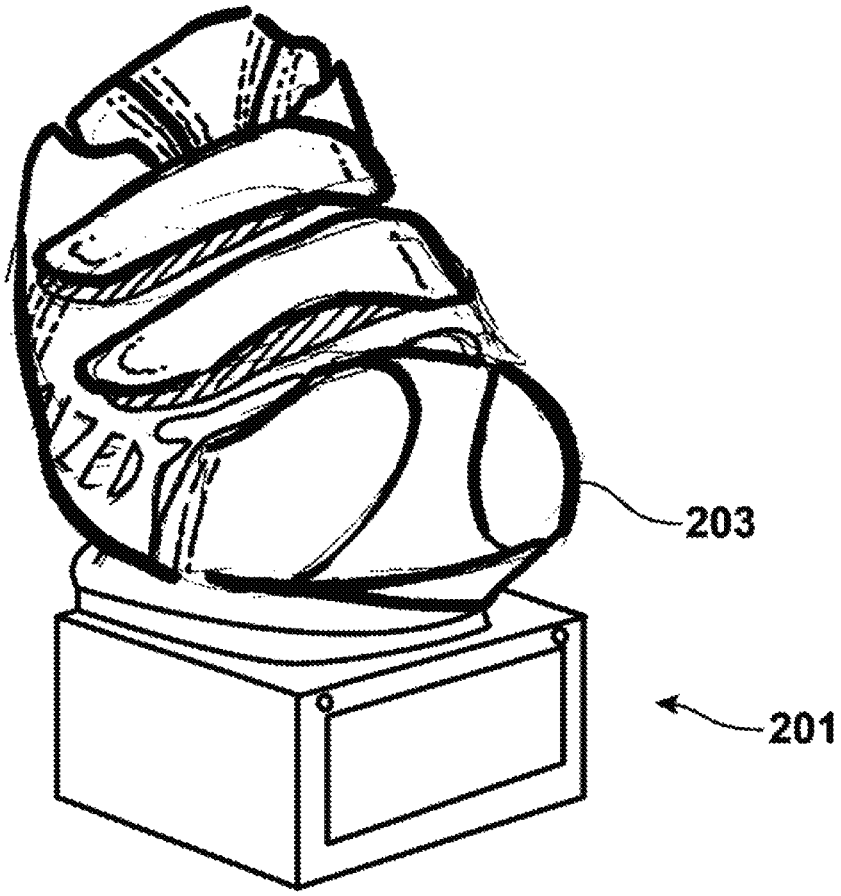
Figure 5:
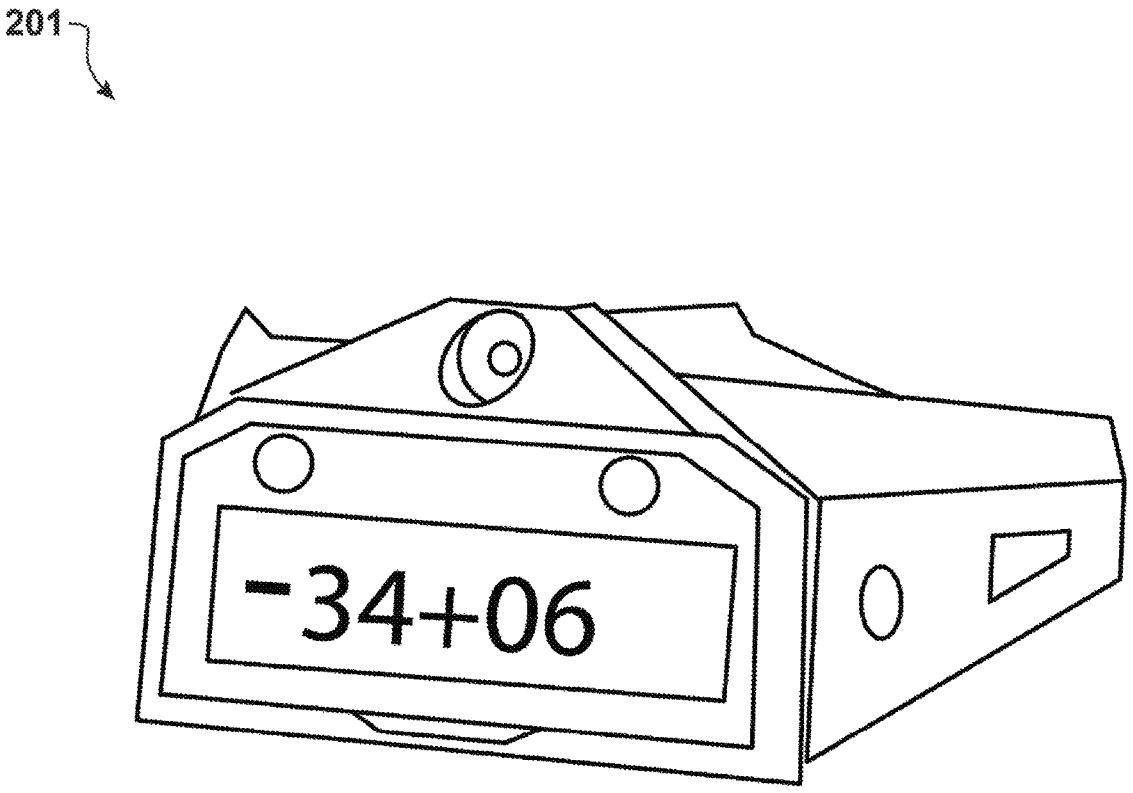

FIGS. 3-5 illustrate another device known to the art which may be used in a process for adjusting cleats. This device 201 takes the form of a special pedal which is installed in place of the normal pedal on the user's bicycle, and which measures the position and amplitude of the user's pedal stroke. As explained at roadbikereview.com, in the first step of the process which uses this device 201 to align cleats, the cleats are set up properly on the cyclist's shoes 203 by having the cyclist stand up against a wall and by measuring the ball of the cyclist's foot in relation to the wall. This relation is then translated onto the cyclist's shoe 203.

Once the cleats are installed properly, the fitter positions the cyclist's bicycle on a trainer with the device 201 installed in place of the bicycle's normal pedals. The cyclist then pedals the bicycle, and the device 201 measures and analyzes each complete cycle of the pedal stroke. As part of this process, the cyclist 205 pedals 3 minutes at a regular cadence of 60-90 RPM while the device 201 measures values for both position and amplitude of the cyclist's stroke. The position value helps the fitter determine the best position on the shoe 203 for the cleat, while the amplitude value helps the fitter determine which cleat will best suit the cyclist. The process is done twice to get an average value for position, which the fitter then uses to correct the positioning of the cleat.

Once the fitter determines the best angular position for the cleat on the shoe 203, the fitter uses a special angular measuring tool that repositions the cleat in the optimum position on the shoe 203. The cyclist then cycles another 3 minutes to verify that the adjustments are correct and that the cleats fall within range of the optimum position. Depending on the amplitude values recorded during the fit, the fitter may swap out the cyclist's cleat for a different cleat.

While the foregoing device and methodology may have some desirable features, it also suffers from some infirmities. For example, the use of this device requires tools for its attachment and removal, and further requires the existing pedals of the bicycle to be replaced, and then reinstalled, after cleat adjustment is completed. Moreover, it does not provide a visual indication of the cleat alignment at different portions of the pedal stroke.

Figure 6:
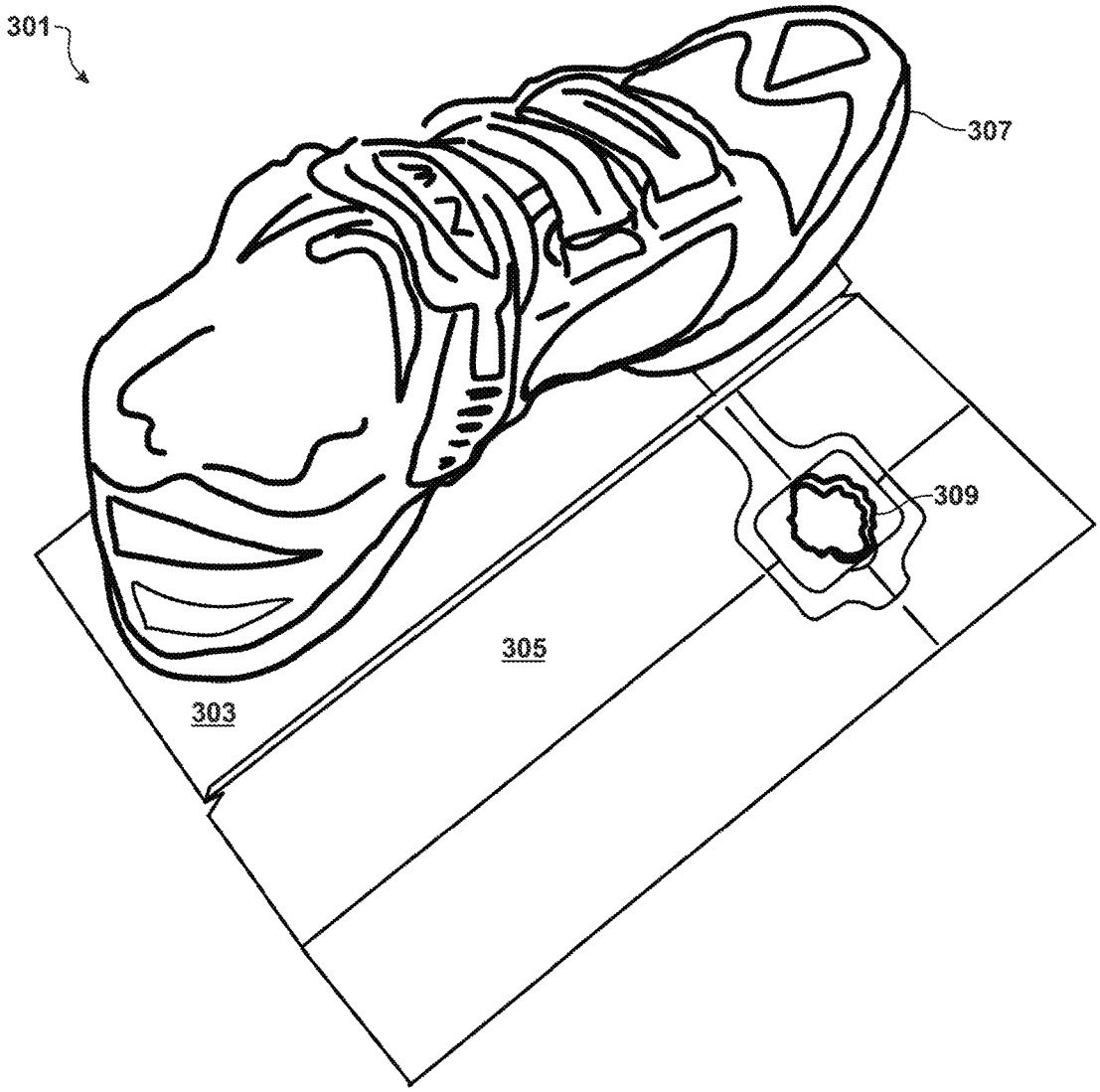
FIGS. 6-7 are illustrations of a third prior art system for cleat adjustment.
Figure 7:
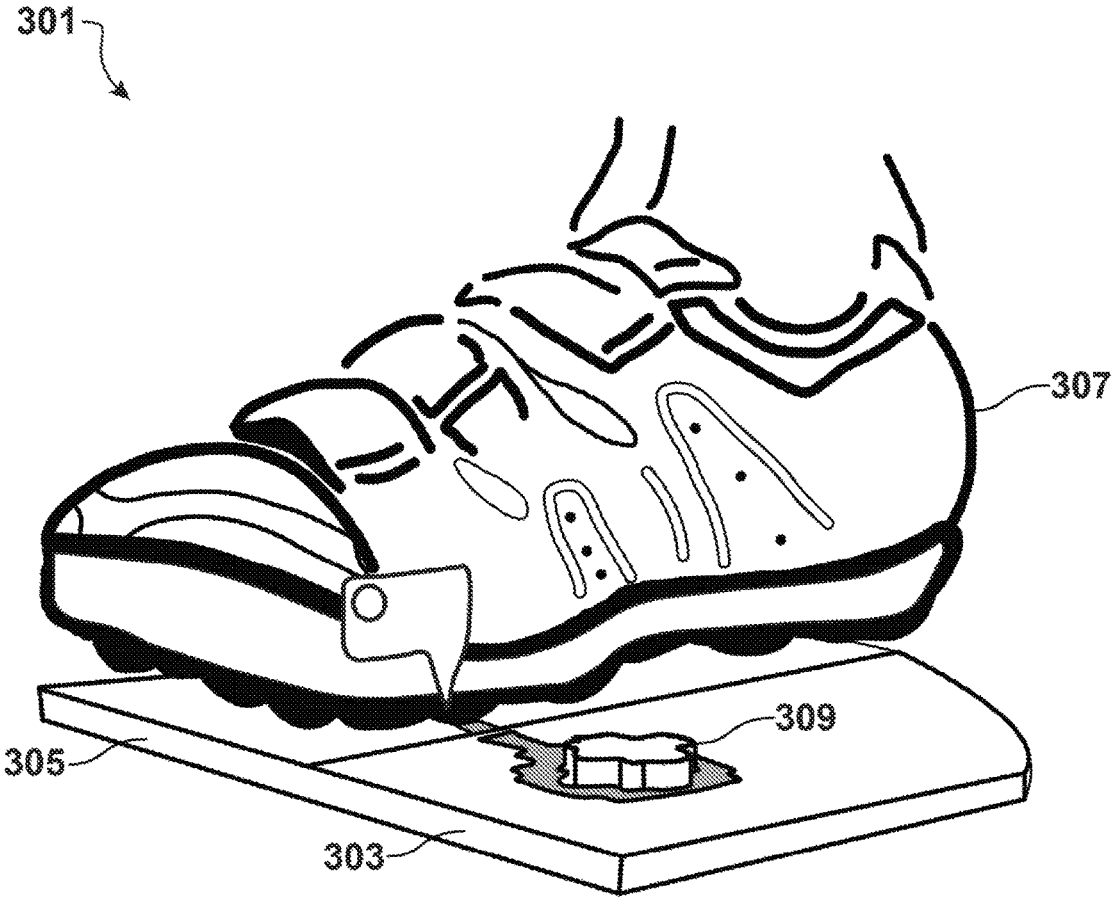

FIGS. 6-7 illustrate yet another method for aligning cycling cleats. This method, which is described under the title "ERGON TP1 Cleat Tool" at vimeo.com, features a tool 301 which includes a left component 303 for the left shoe and a right component 305 for the right shoe. During use, the cleats are mounted to the cycling shoes 307 just tight enough so they are movable with the application of moderate force. The cleats fit tightly into pockets 309 made for them in the tool 301. The surface of the tool 301 has a grid on it so that the relation of the cleat to the ball of the foot may be readily ascertained.

The instructions accompanying the tool explain how to locate the ball of the foot, and stickers 311 (see FIG. 7) are provided with the tool to place on the cycling shoes to mark this position. This approach purportedly allows the user to get the fore/aft cleat position correct, and the open pocket 309 allows the cleats to be tightened while the cyclist's shoe 307 is in the tool 301. The tool 301 may then be utilized to place both cycling shoes at the same angle in relation to the centerline. The orientation of the cleats is then checked on the user's bicycle and fine-tuned as needed.

While the foregoing device and methodology may have some desirable features, it also suffers from some infirmities. For example, this device assumes that the proper cleat alignment may be determined solely from the knowledge of the position of the ball of the cyclist's foot with respect to the cycling shoe. However, the entire leg of the cyclist contributes to the cyclist's natural gait. Hence, this device and approach does not provide an angular measurement of the cleat adjustment needed to correct for the user's gate. Moreover, if the foregoing alignment does not coincide with the cyclist's natural gait, then a trial-and-error approach must be used to make corrections. Indeed, the tool of FIGS. 6-7 appears to be primarily useful for reproducing cleat alignments from one set of cycling shoes on another.

It has now been found that the foregoing infirmities may be overcome with the devices and methodologies disclosed herein. In particular, devices are disclosed herein which accurately measure the angular alignment of bicycle pedal cleats to bicycle shoes, and which are equipped with an integrated mechanism to make adjustments to the angular alignment of the shoe and pedal cleat while the cyclist being fitting is riding a stationary bicycle (which may be the cyclist's own bicycle mounted on a trainer), an exercise bicycle, or a specially created fitment bicycle at a bicycle retail store.

In a preferred embodiment, the device disclosed herein attaches to existing pedal systems, and hence does not require the pedals to be removed for cleat adjustment. Moreover, this device is capable of making angular measurements to quantify the angular adjustment needed in the cleats to compensate for the user's gait, does not require any special tools or equipment to attach the device to a pedal system, and is equipped with an integrated handle that facilitates its removal. In addition, the device allows cleat adjustments to be made while the user's shoe is engaged with the device, and provides a large platform that engages the user's shoe.

In a preferred embodiment, the device consists of a left tool and a right tool. Each tool is equipped with a tool base plate, a pedal attachment cleat, a lubrication plate, a cleat alignment disc, an optional cleat adapter plate, a tool handle, and an angular alignment indicator rod. The tool base plate has an extension lever with markings used as an angular reference, and is attached to the cleat alignment disc at a single point in the center of the two parts. The lubrication plate is sandwiched between these two parts such that the cleat alignment disc can rotate freely against the base plate.

An angular alignment rod and a tool handle are attached to the cleat alignment disc. The tool handle protrudes from the cleat alignment disc such that, when the disc is engaged with a rider's shoe and pedal cleat, the tool handle extends beyond the perimeter of the shoe. The angular alignment rod is attached to the cleat alignment disc such that it is parallel to the centerline of the tool base plate when the cleat alignment disc and the base plate are orthogonal. A pedal cleat is affixed to the bottom side of the base plate.

In a preferred embodiment of the method of use of the foregoing device, by using the pedal cleat affixed to the bottom of the base plate, a tool assembly is attached to a pair of existing bicycle pedals in the same manner that a bicycle shoe with a pedal cleat is attached. The rider's saddle is adjusted to compensate for the higher foot platform. Cleats are attached to a pair of the rider's shoes loosely. The rider's puts on the shoes, sits on the bicycle, and places their feet on top of the tool such that the cleat in the shoe engages the cleat alignment disc. While the rider is pedaling the bicycle, the alignment rod moves to a neutral position relative to the rider's biomechanical alignment. The tool handle is manipulated until the alignment rod is parallel to the centerline of the base plate.

Figure 9:
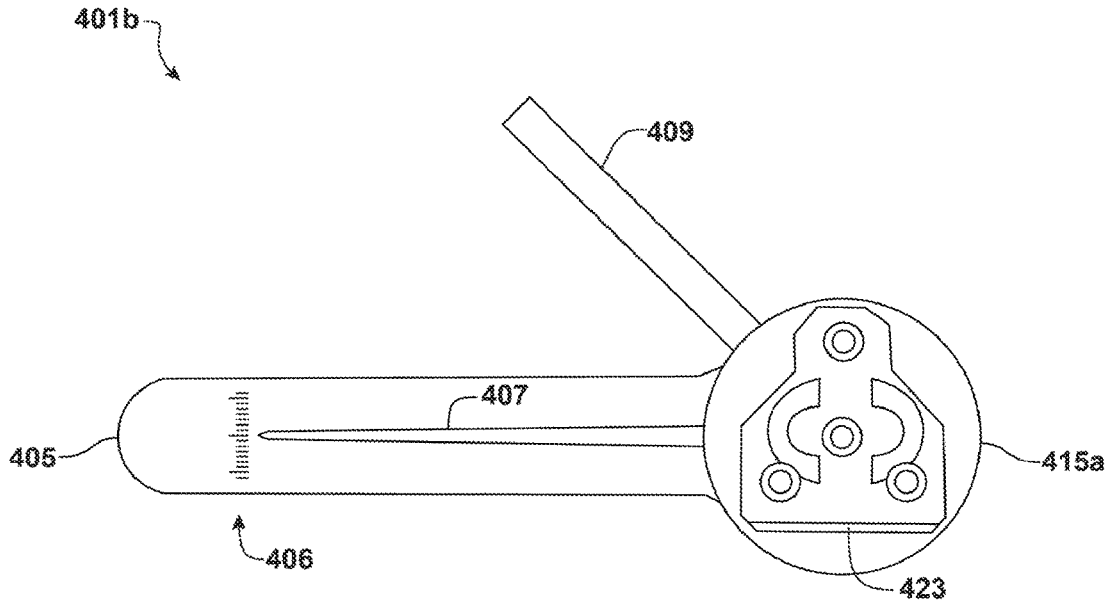
FIG. 9 is a top view of an embodiment of a tool (left foot) of the type described herein.
Figure 10:
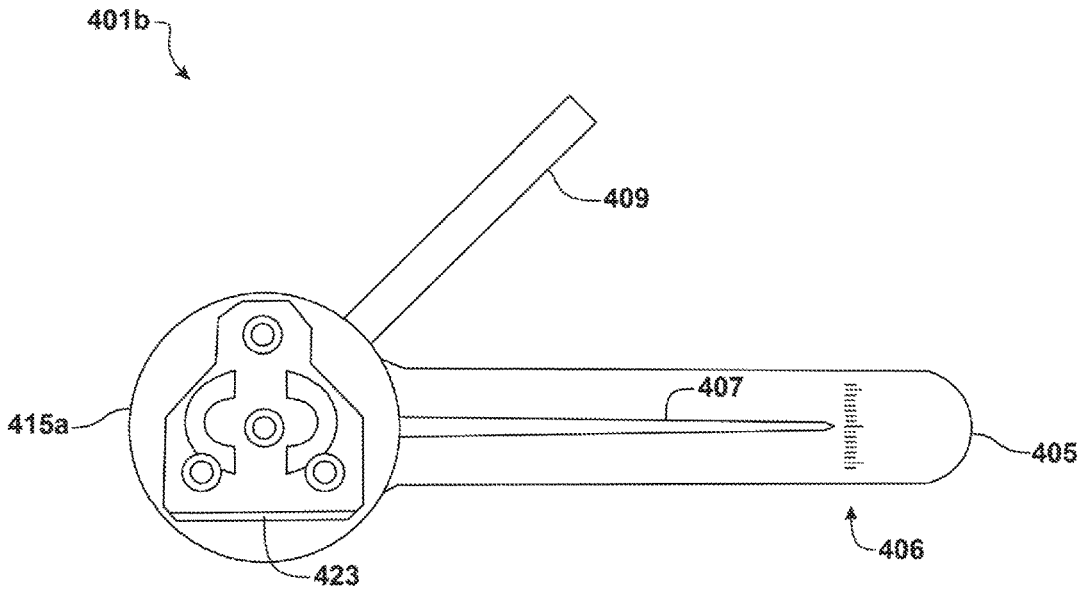
FIG. 10 is a top view of an embodiment of a tool (right foot) of the type described herein.
Figure 11:
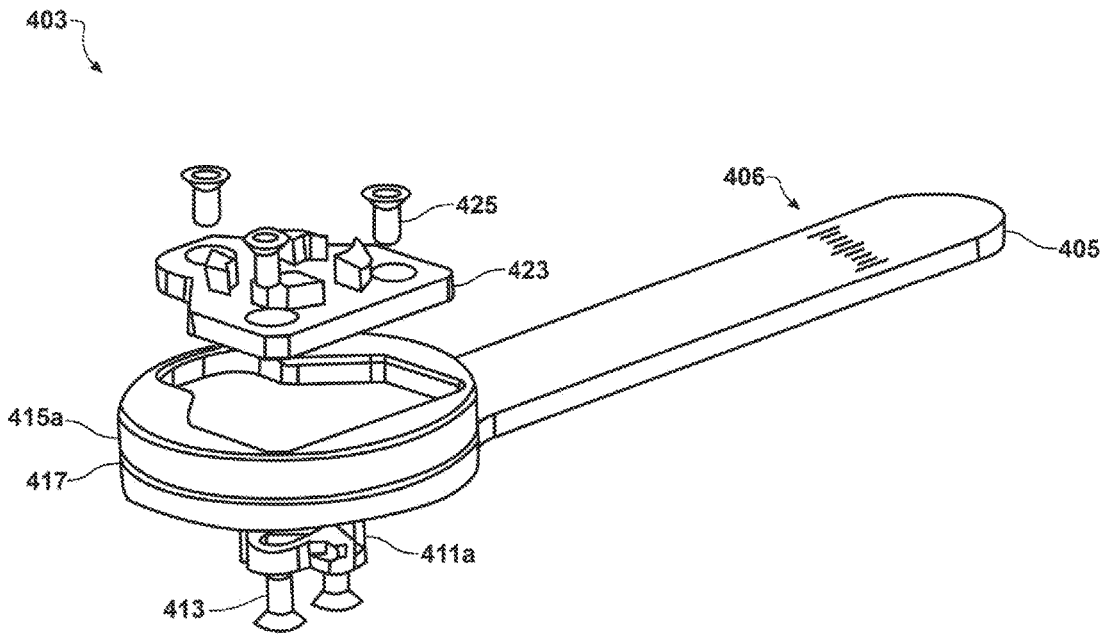
FIGS. 11-12 are illustrations (partially exploded) of the base tool assembly of the embodiment of FIG. 8.
Figure 12:
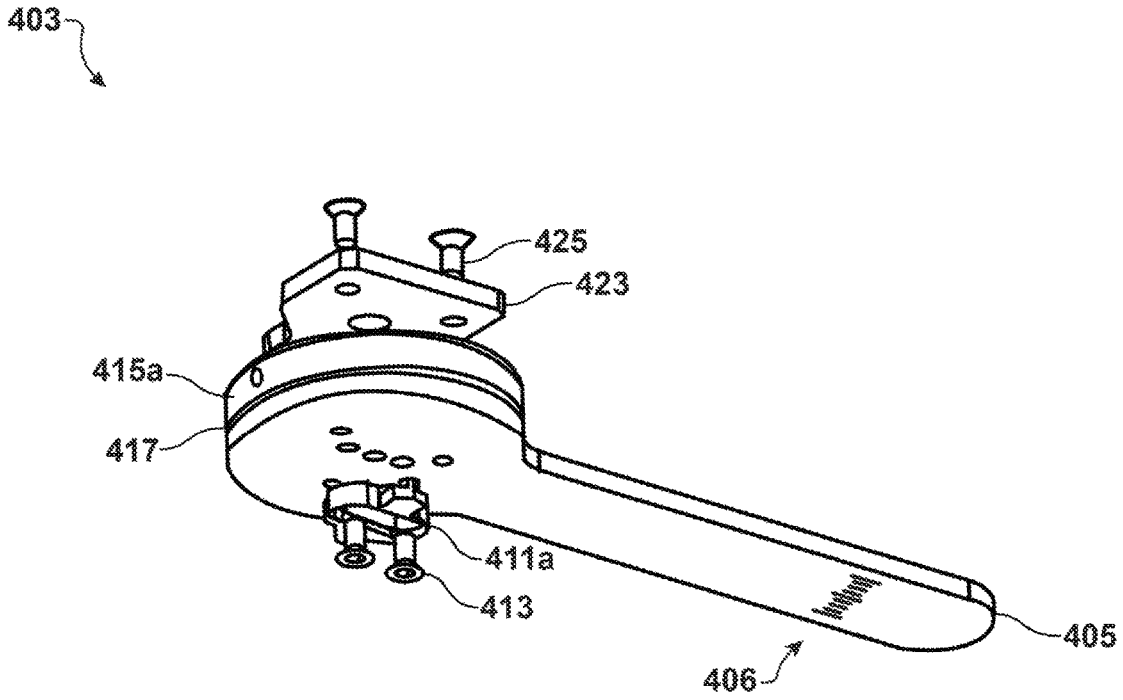
Figure 13:
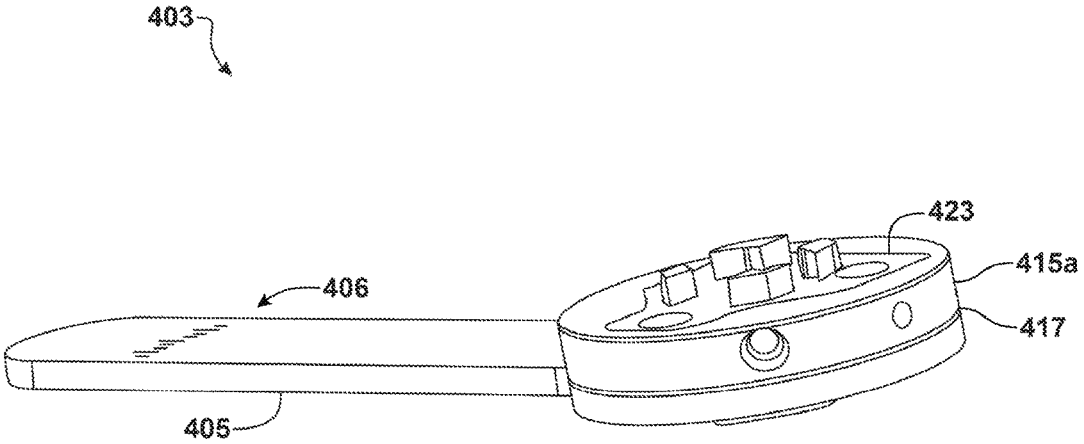
FIGS. 13-15 are illustrations of the base tool assembly of the embodiment of FIG. 8.
Figure 14:
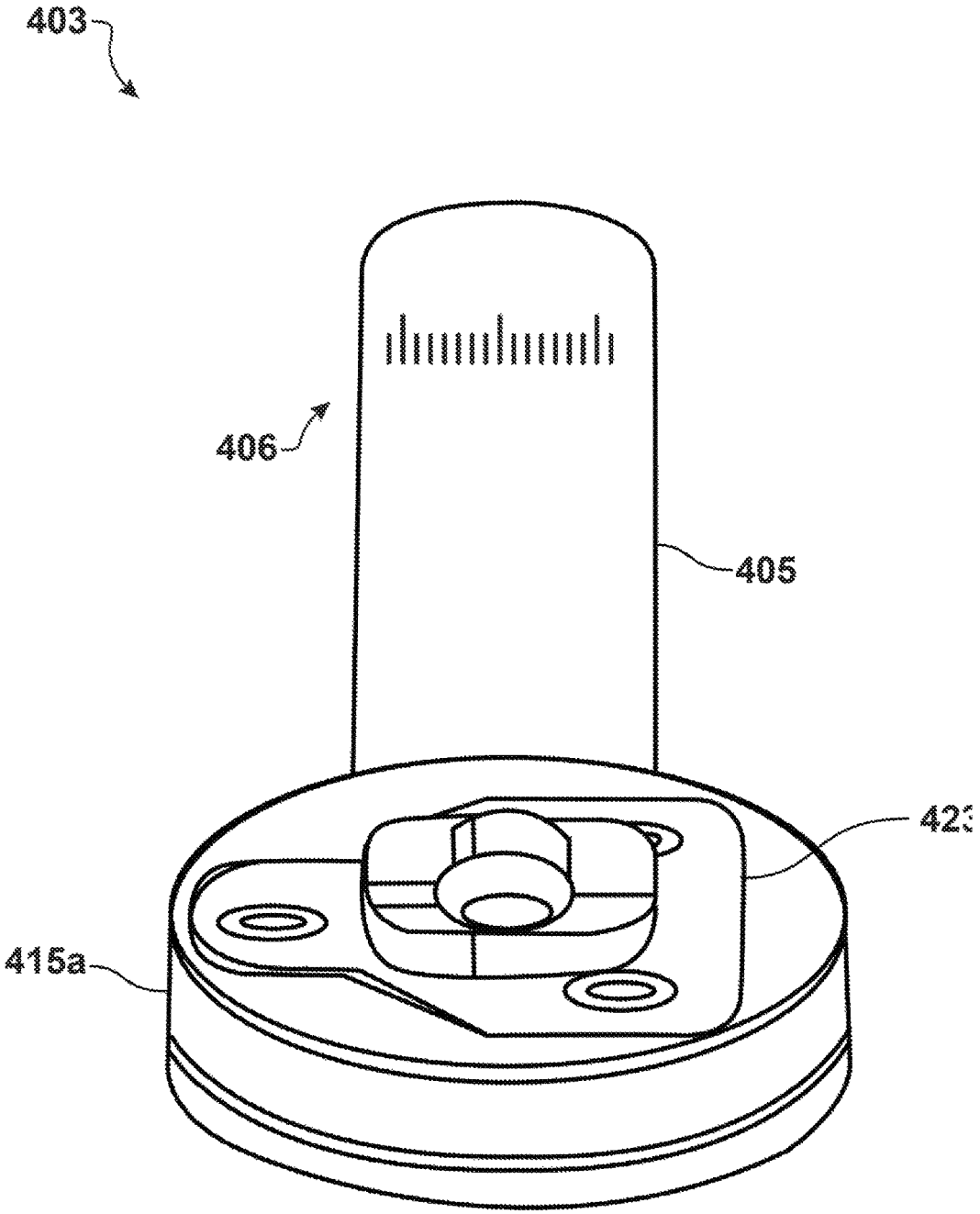
Figure 15:
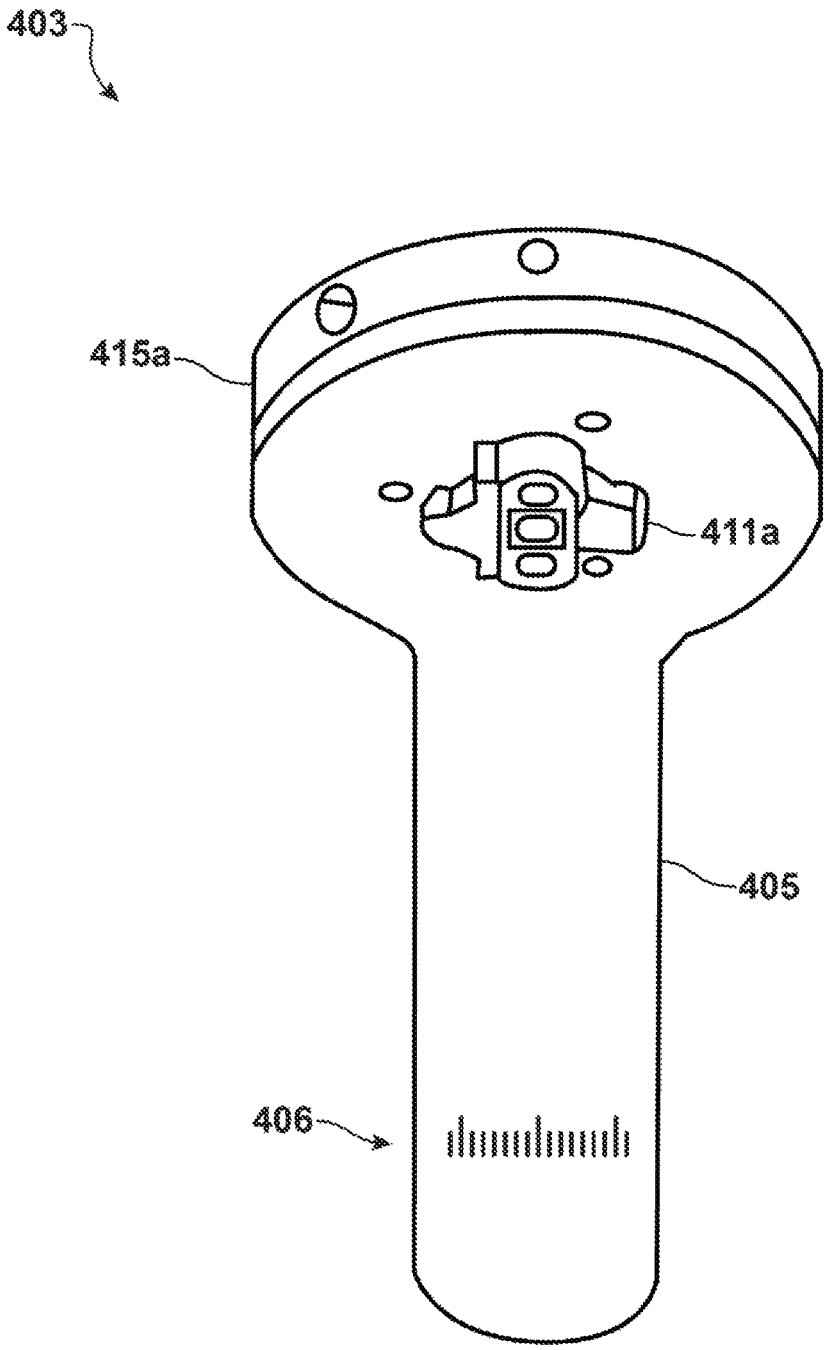
Figure 16:
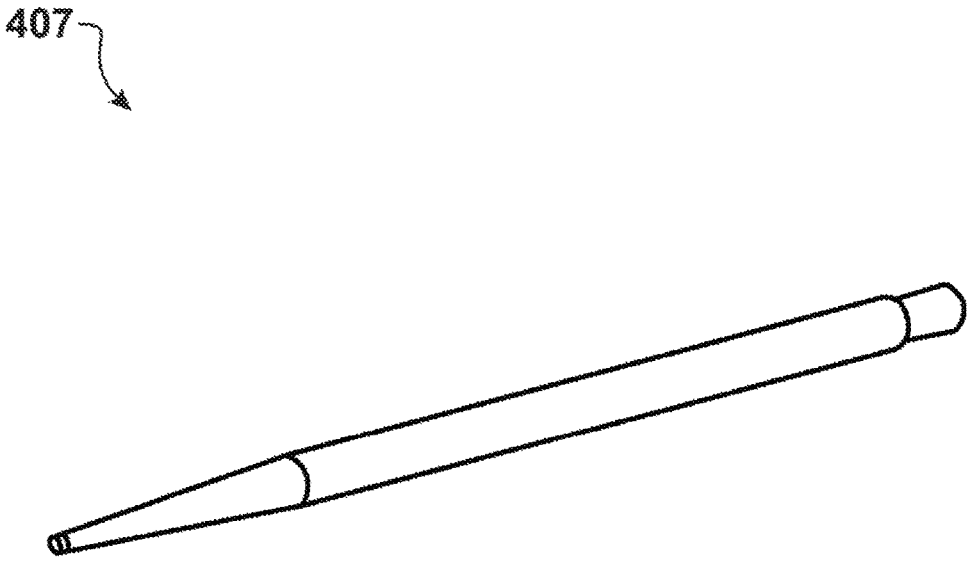
FIG. 16 is an illustration of an alignment rod for the embodiment of FIG. 8.
Figure 17:
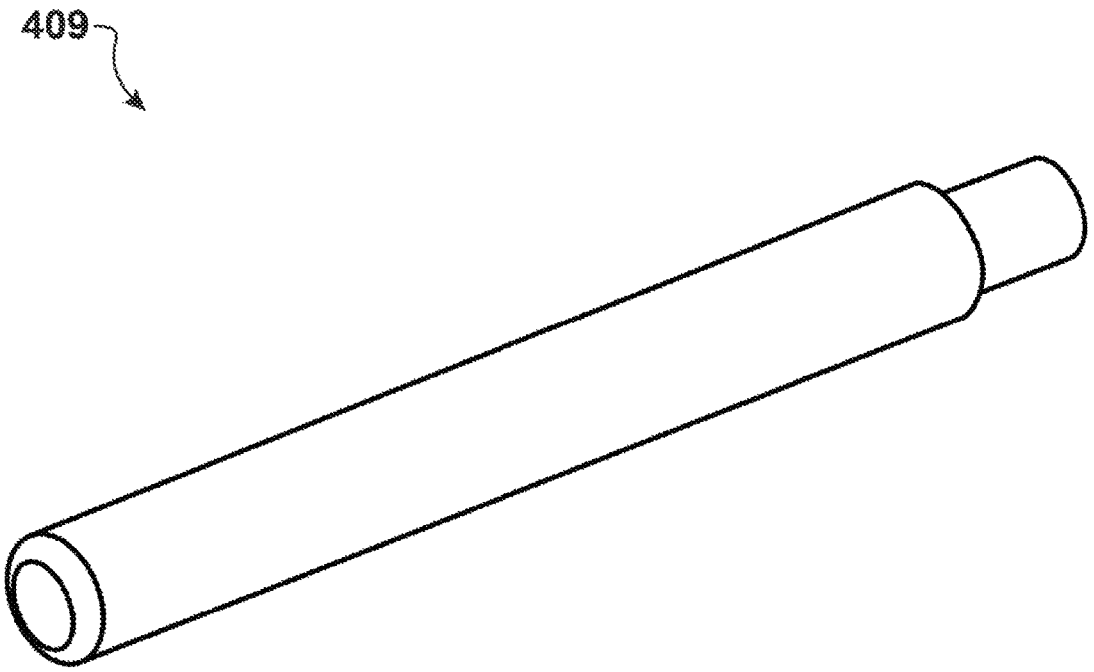
FIG. 17 is an illustration of a tool handle for the embodiment of FIG. 8.

FIGS. 8-10 illustrate a first particular, non-limiting embodiment of a cleat adjustment device 401 in accordance with the teachings herein. As seen therein, the cleat adjustment device 401 is implemented as a pair of tools, which includes a tool 401*a* for the left foot (see FIG. 9) and a tool 401*b* for the right foot (see FIG. 10).

Figure 18:
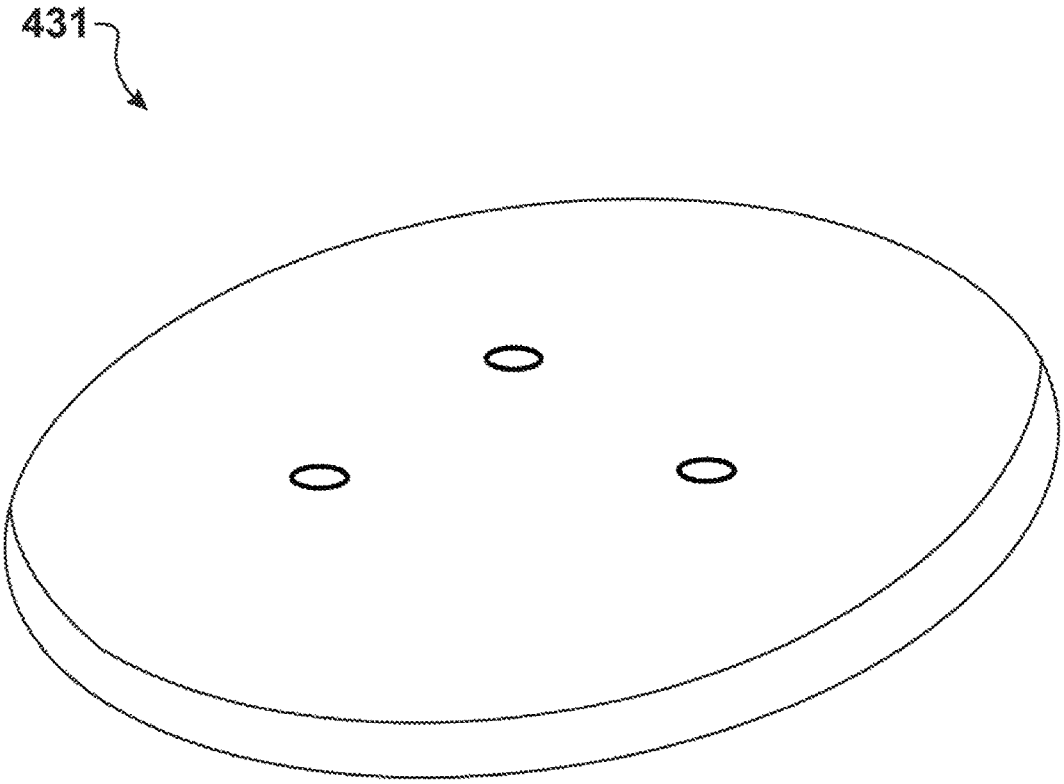
FIG. 18 is an exploded view of a second embodiment of a cycling cleat adjustment tool in accordance with the teachings herein.
Figure 19:
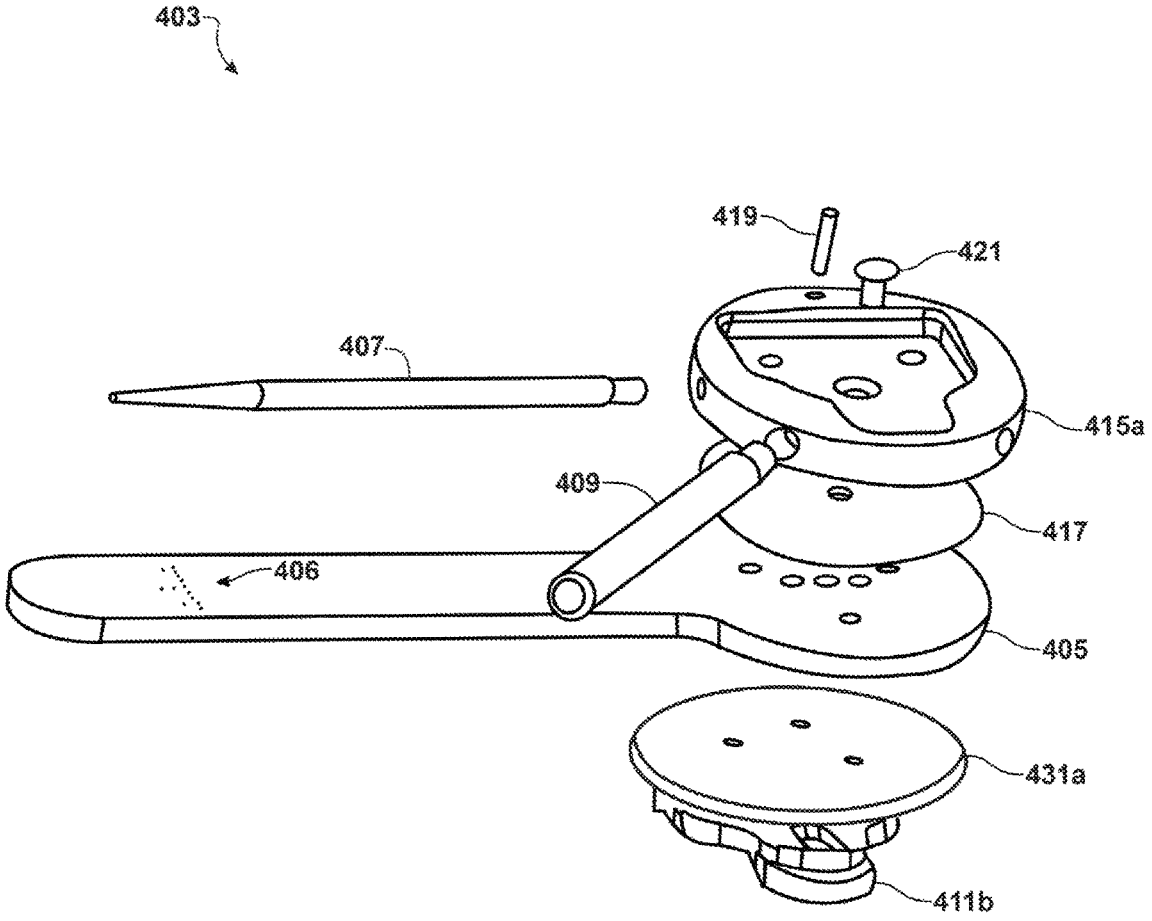
FIG. 19 is an illustration of a shoe plate for the embodiment of FIG. 18.
Figure 20:
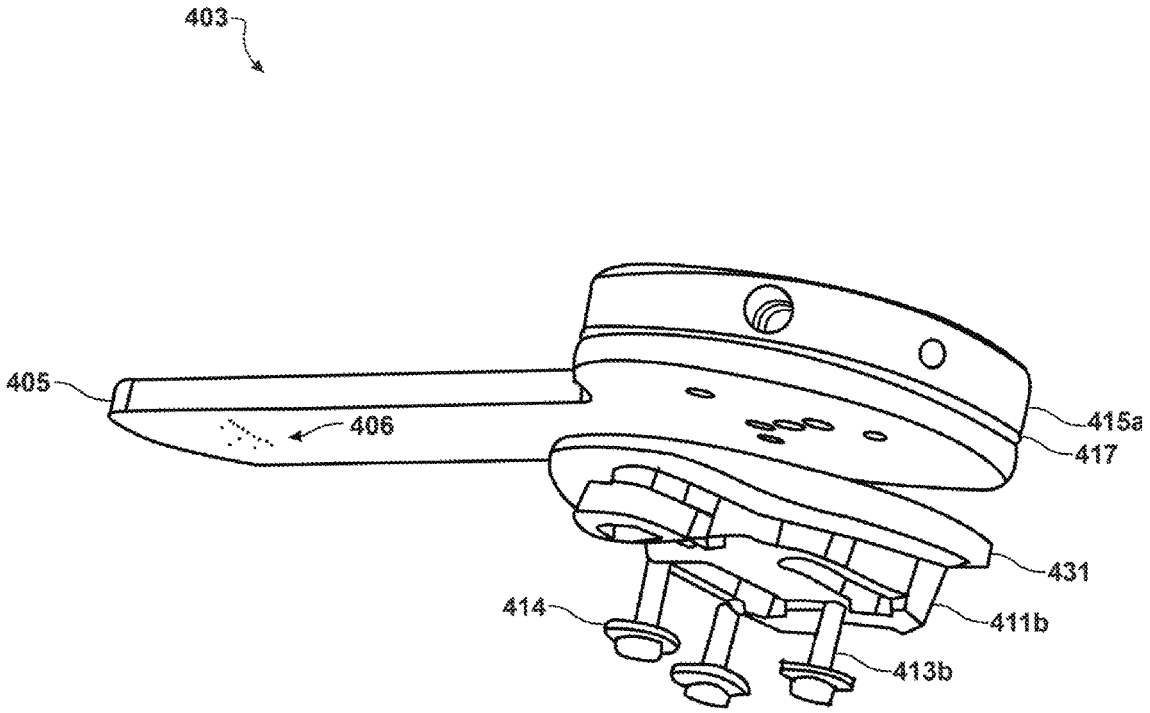
FIG. 20 is an illustration of the means by which the pedal cleat is attached to the base tool assembly in the embodiment of FIG. 18.
Figure 21:
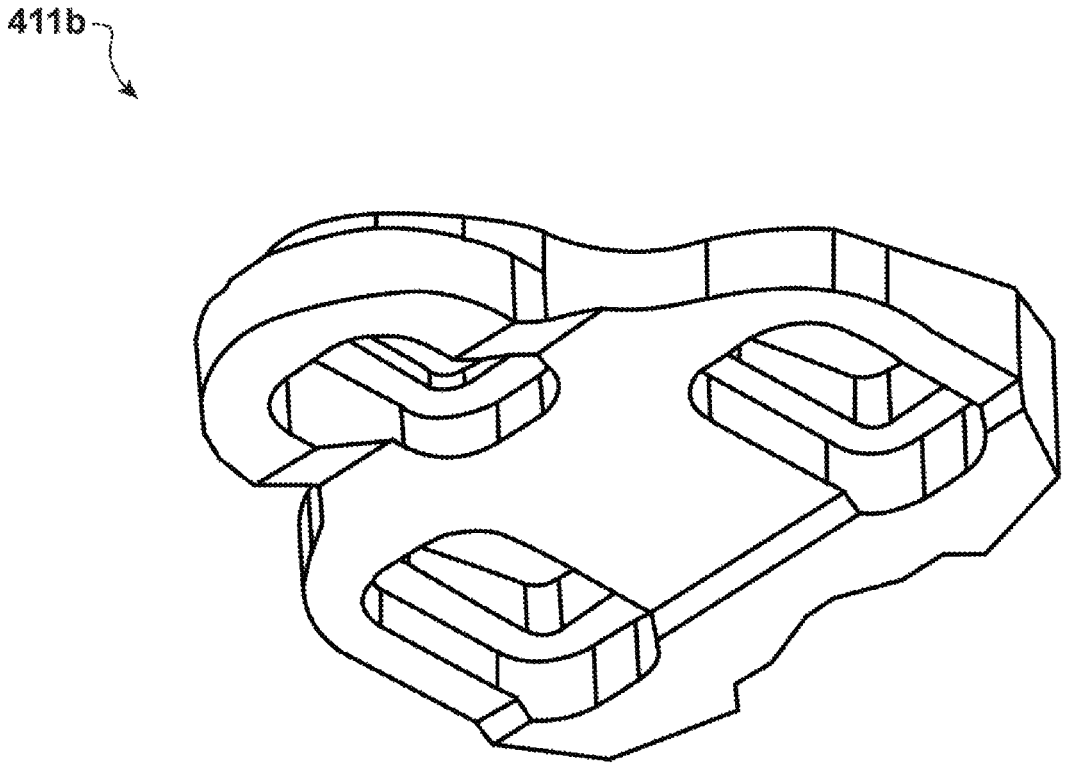
FIG. 21 is an illustration of the cleat for the embodiment of FIG. 18.
Figure 22:
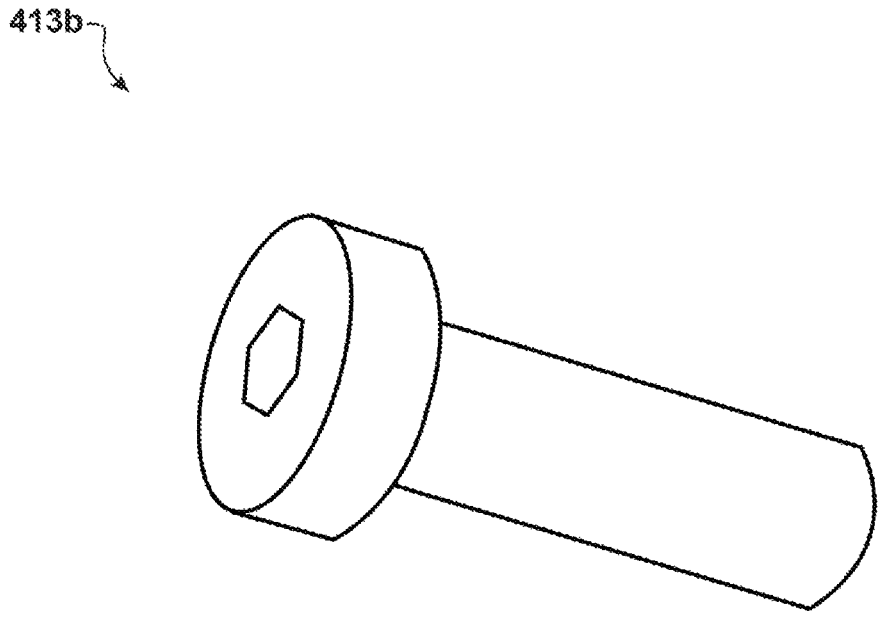
FIG. 22 is an illustration of a pan head socket cap screw for the embodiment of FIG. 18.
Figure 23:
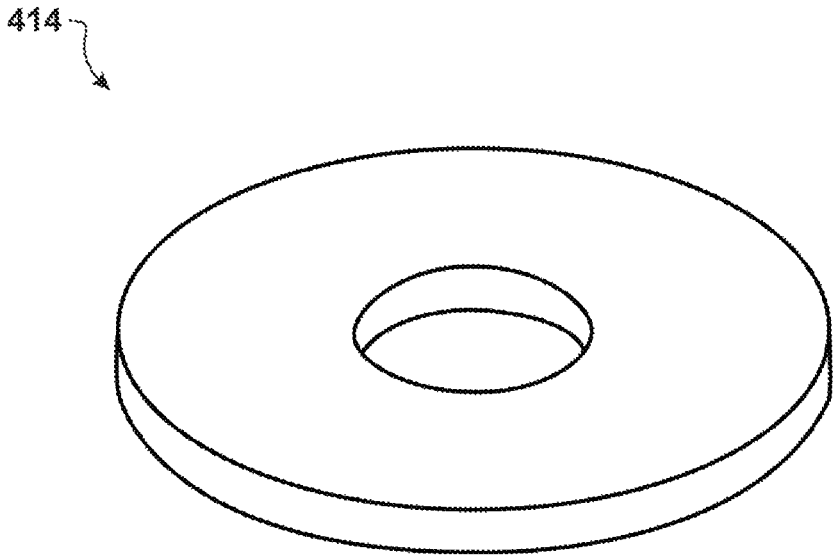
FIG. 23 is an illustration of a washer for the embodiment of FIG. 18.

The components of the cleat adjustment device 401 of FIGS. 8-10 are shown in FIGS. 11-17. As seen therein, each cleat adjustment device 401 comprises a base tool assembly 403 (shown in greater detail in FIGS. 11-15), a base plate 405 having a rounded portion with a first protrusion extending therefrom (best seen in FIG. 8) with a set of indicia 406 thereon, a (preferably brass) alignment rod 407 (shown in greater detail in FIG. 16), a (preferably stainless steel) tool handle 409 (shown in greater detail in FIG. 17), a cleat 411*a* (best seen in FIGS. 8 and 12; the depicted embodiment features a Shimano cleat), a set of cleat fasteners 413, a shoe plate or rotational disc 415*a* (shown in greater detail in FIG. 18), a (preferably HDPE or Teflon) lubrication plate 417, a stop pin 419, and a fixing bolt 421 which secures the rotational disc 415*a* (preferably of the type manufactured by Look Cycle, Inc. under the brand name KEO™) and the lubrication plate 417 to the base plate 405. The particular embodiment depicted further comprises an SPD adapter 423 which is secured to the rotational disc 415*a* with a set of adapter bolts 425. As seen in FIGS. 8 and 11-15, each base tool assembly 403 comprises the base plate 405, rotational disc 415*a*, SPD adapter 423, cleat 411*a*, cleat fasteners 413, lubrication plate 417, fixing bolt 421 and adapter bolts 425.

The manner in which the base tool assembly 403 is assembled may be appreciated from FIG. 8, which depicts a configuration of the cleat adjustment device 401 which is suitable for adjusting Shimano SPD cleats. The SPD adapter 423 is a plate which allows two-bolt SPD cleats 411*a* to be installed on a road shoe with a three-hole drilling. Such adapters are commonly used to attach SPD cleats to a three-hole road shoe to use in a spinning class on a SPD spinning bicycle. During assembly, the base tool assembly 403 is placed on a work surface. Preferably, the left-foot base tool assembly 403*a* is placed on the left hand side of the person assembling the devices, and the right-foot base tool assembly 403*b* is placed on the right hand side. The base tool assemblies 403 are positioned so that the rotational disc 415*a* and cleat adapter 423 are on top, and the attached cleat 411*a* is on the bottom, with the cleat adjustment disc (rotational disc) 415*a* and the cleat adapter 423 facing in the same direction as the cleat on the cyclist's shoe.

The alignment rods 407 and tool handles 409 are then attached to the base tool assemblies 403. For this purpose, the alignment rods 407 are preferably equipped on one end with threading that rotatingly engages a first threaded aperture of complimentary shape in the rotational disc 415*a*. Similarly, the tool handles 409 are preferably equipped on one end with threading that rotatingly engages a second threaded aperture of complimentary shape in the rotational disc 415*a*. The first and second threaded apertures in the rotational disc 415*a* are preferably offset at an angle within the range of about 20° to about 90°, more preferably within the range of about 30° to about 60°, and most preferably are offset by about 45°. Once completed, the device may be used to adjust the orientation of cycling cleats.

The device depicted in FIG. 8 is adaptable to accommodate both Shimano SPD cleats and Shimano SH-SM51 and SH-SM56 cleats. When used to adjust SPD cleats, the SPD adaptor plate 423 and associated adapter bolts 425 are omitted from the device 401. When used to adjust Shimano SH-SM51 and SH-SM56 cleats, the SPD adapter plate 423 is positioned into place in the depression formed in the rotational disc 415*a*, and is secured into place with the adapter bolts 425 (which are preferably three M5-1.0×12 mm flathead screws). A drop of a suitable lubricant, such as a Teflon™-based lubricant, may be applied to the screws before they are tightened. Preferably, the screws are tightened to about 2 nM. If not already in place, a zero float SPD SH-SM56 cleat 411*a* is installed by lubricating the screws 413 (as described above) and gently tightening each one until the head of each screw 413 is flush with the cleat 411*a*. Each screw is preferably torqued to about 5 nM.

FIGS. 18-23 illustrate the manner in which the device 401 may be reconfigured to accommodate LOOK KEO black, red and grey cleats. With reference thereto, the SPD adapter plate 423 (see FIG. 8) is removed from the rotational disc 415*a* and the SPD cleat 411*a* (see FIG. 8) is removed from the bottom of the base plate 405. The black KEO cleat 411b and the black KEO cleat adapter plate 431 are installed on the bottom of the device using three M5 low profile pan head socket cap screws 413*b* (M5-0.8×16 mm) and six (preferably M5 steel) washers 414. The rotational disc 415*a* is equipped with a depression on a major surface thereof within which an adapter 423 or key is disposed that releasably engages a cleat on a cycling shoe. Two washers 414 are employed per cap screw 413*b*, and the black KEO cleat adapter disc 431*a* is aligned so that the thickest edge of the KEO cleat adapter disc 431*a* is to the outside edge of the device. The KEO cleat 411*b* is then aligned, preferably with the use of a straight edge, and the three low profile cap screws 413*b* are tightened to finger tightness. The centerline nubs on the KEO cleat 411*b* are aligned with the centerline of the device, and the cap screws 413*b* are secured down to about 4 nM.

Figure 24:
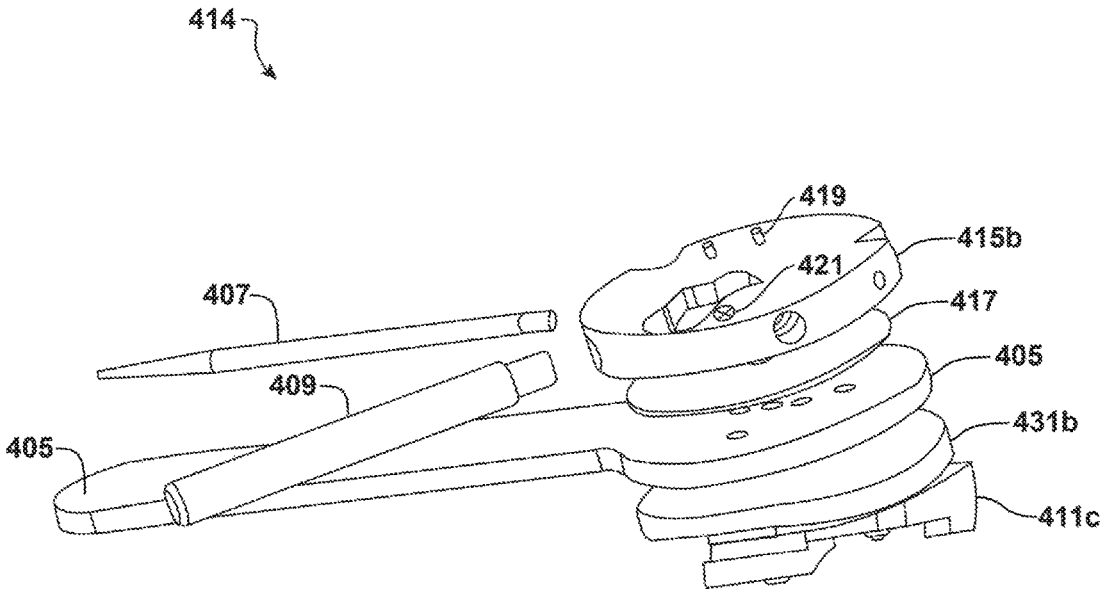
FIG. 24 is an exploded view of a third embodiment of a cycling cleat adjustment tool in accordance with the teachings herein.

FIG. 24 illustrates another particular, non-limiting embodiment of a cleat adjustment device 401 in accordance with the teachings herein. The device in this embodiment is similar in most respects to the device of FIG. 8, but is configured for SPD-SL red cleats. These cleats are described, for example, under the title "Shimano SH10 SPD-SL Cleat Set Fixed Red" at artscyclery.com, which is incorporated herein by reference in its entirety. Hence, the rotation disc 415*b* in this embodiment is adapted to accommodate SPD-SL cleats, and the shoe adapter 431*b* is equipped with an SPD-SL red cleat 411*c*.

Figure 25:
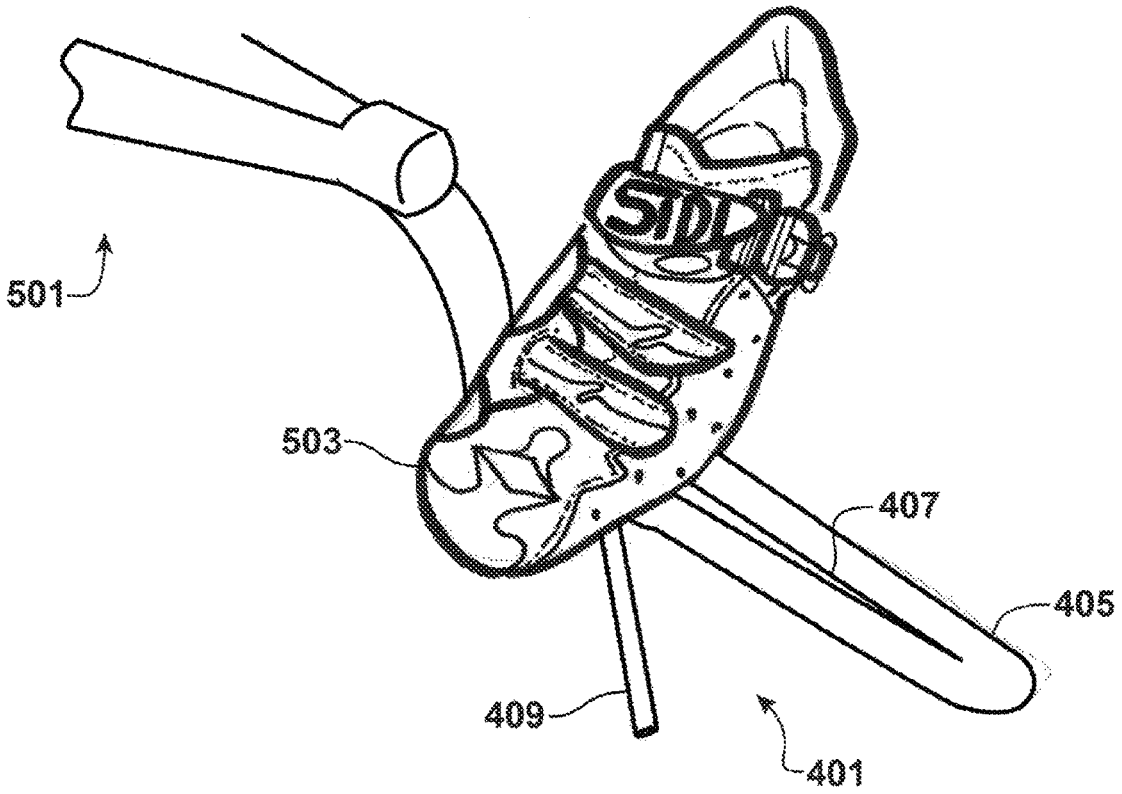
FIGS. 25-27 are illustrations of the steps in a process of using the cycling cleat adjustment tool of FIG. 8 in adjusting cycling cleats to the gait of a user.
Figure 26:
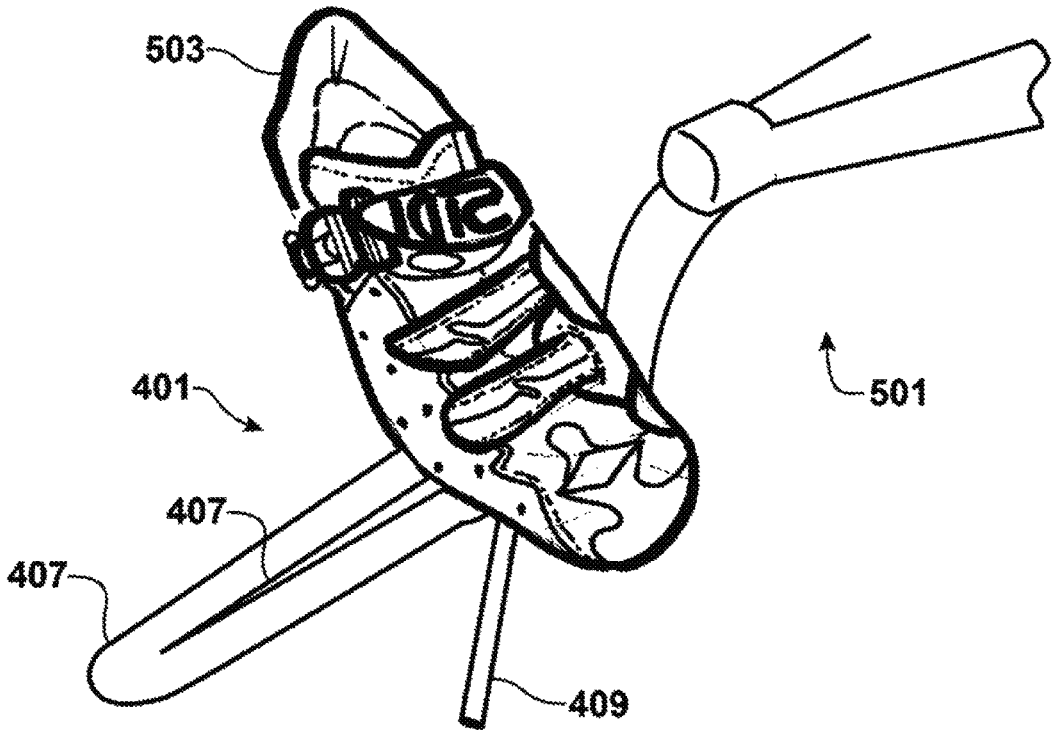
Figure 27:
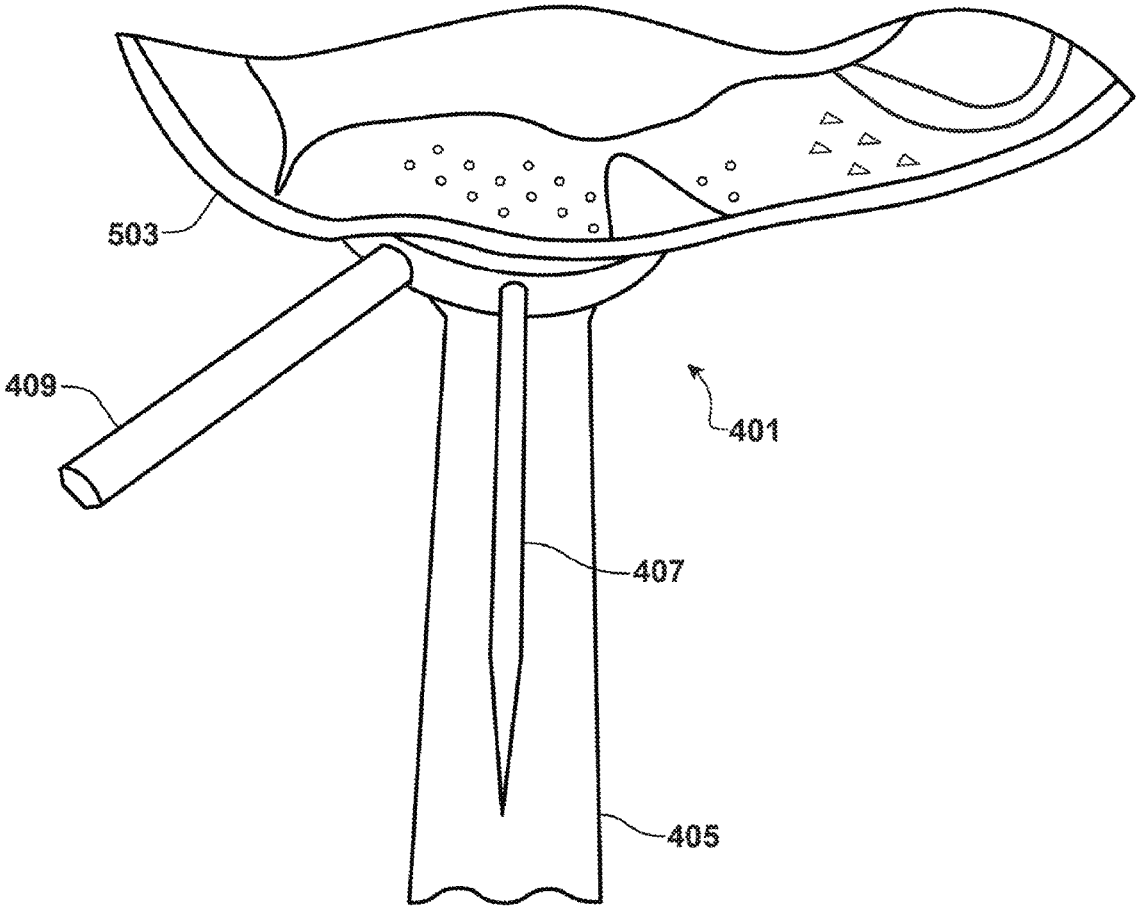

FIGS. 25-27 illustrate the method of using the device described herein to adjust cycling cleats. This is described in greater detail under the titles "CleatMaster How To Use" and "CleatMaster Cleat Adjustment" at youtube.com, which are incorporated herein by reference in their entirety.

As a preliminary step, a cleat fitting platform 501 is selected. This platform 501 should match the rider's usual cycling position as closely as possible. The platform 501 is preferably the rider's bicycle mounted in a stationary trainer, but may also be a dedicated fitness cycle at a cycling shop, or an indoor cycling trainer such as the REAL RYDER™ trainer or the KEISER™ trainer. Preferably, regardless of the platform 501 selected, minimal resistance is used in the pedals.

If the user's bicycle is utilized as the platform 501, it is preferred that the largest chain ring and smallest cog is selected with no resistance supplied by the trainer. If a dedicated fitness cycle is utilized, the resistance is preferably set as low as possible, and the cycle is adjusted to the rider's position. If an indoor cycling trainer is utilized, the resistance is preferably set to "freewheel" and the cycle is adjusted to the rider's standard position. Preferably, regardless of the platform, the saddle-to-pedal start height is raised by the delta amount indicated in TABLE 1 below:

TABLE 1

Saddle Height Deltas

| | | Cleat On Shoe | |
|---|---|---|---|
| | | SPD | Look KEO |
| Cleat On Shoe | Shimano SPD | 25 mm | 19 mm |
| | Shimano SPD-SL | 31 mm* | 25 mm* |
| | Look KEO | 31 mm | 25 mm |
| | Look delta | 31 mm | 25 mm |
| | Campagnolo | 31 mm* | 25 mm* |
| | Time ATAC | 25 mm* | 19 mm* |
| | Crank Bros. | 25 mm* | 19 mm* |

*Derived Values

The device 401 is then snapped onto the existing pedals of the cleat fitting platform, with the left-footed device applied to the left foot pedal, and the right-footed device applied to the right foot pedal. When properly configured, the device will snap onto any Look KEO pedal, or any Shimano pedal that accepts a Shimano SH-51/56 cleat.

The cleats in the cyclist's shoes 503 are then loosely set. This is preferably accomplished by using the hardware supplied by the shoe 503 or pedal manufacturer. In setting the cleats, the bolts are preferably adjusted to finger tightness, and then tightened an additional 1/16 of a turn. The cleats are preferably set in the neutral position at the start (the neutral position is typically defined in the manufacturing instructions from the manufacturer of the pedal or shoe).

The rider is then asked to pedal for an initial duration (preferably five minutes), during which no adjustments are made. After this initial period has elapsed, the angular alignment is observed while the rider is pedaling. Typically, the rider will settle into a neutral foot position, which may or may not be the neutral position for the pedal. For instance, in the example depicted in FIG. 25, the alignment rod 407 is about four degrees forward.

After the rider has settled into a neutral foot position, cleat adjustments may be made. This may be accomplished by grasping the rider's shoe firmly in one hand, while simultaneously pulling back or pushing forward on the handle 409 to adjust the point to center (that is, to adjust the cleat to achieve a neutral rod 407 location while the rider is pedaling). Thus, in the example shown in FIG. 25, the rod 407 is four degrees forward, so the adjustment is made by pulling back on the handle 409. By contrast, in the example shown in FIG. 26, the rod 407 is about three degrees backward, so the adjustment is made by pushing forward on the handle 409. Since the rider's foot may realign when pedaling stops, it is desirable to note the position of the rod 409 while the rider is pedaling. It is preferred to allow at least a minute between each adjustment.

FIG. 27 shows an example in which a neutral cleat alignment has been achieved. In this position, the cleat position in the rider's shoe matches the angular alignment of the cleat attached to the pedal system. When the rod 409 is statically in this position, or oscillates neutral to this position, cleat adjustment is complete. At this point, the rider's foot may be gently lifted out of the pedal, and the cleats may be tightened to manufacturing specifications.

The above description of the present invention is illustrative, and is not intended to be limiting. It will thus be appreciated that various additions, substitutions and modifications may be made to the above described embodiments without departing from the scope of the present invention. Accordingly, the scope of the present invention should be construed in reference to the appended claims.

What is claimed is:

1. A tool for adjusting the orientation of cycling cleats on cycling shoes, comprising:

a base plate having a rounded portion with a first protrusion extending therefrom, wherein said first protrusion has a series of indicia thereon;

a pedal adapter which is disposed on a first major surface of said rounded portion and which releasably engages a pedal on a bicycle or cycling machine;

a cleat adapter, disposed on a second major surface of said rounded portion, which releasably engages a cleat on a cycling shoe and which is rotatably adjustable with respect to said rounded portion;

a second protrusion which protrudes from said cleat adapter and which overlaps said first protrusion; and a handle which protrudes from said cleat adapter;

wherein an orientation of the second protrusion with respect to the indicia indicates an orientation of the cleat with respect to the pedal adapter.

2. The tool of claim 1, wherein said second protrusion is in the shape of a needle.

3. The tool of claim 1, wherein said handle and said second protrusion are disposed at an angle to each other, and wherein said angle is within the range of 20° to 9°.

4. The tool of claim 1, wherein said handle and said second protrusion are disposed at an angle to each other, and wherein said angle is within the range of 30° to 60°.

5. The tool of claim 1, wherein said handle and said second protrusion are disposed at an angle to each other, and wherein said angle is within the range of 40° to 50°.

6. The tool of claim 1, wherein the second major surface of said rounded portion of the base plate is a planar surface upon which said cleat adapter is disposed, and wherein said handle and said second protrusion have longitudinal axes that are essentially parallel to the planar surface of said rounded portion.

7. The tool of claim 1, wherein said cleat adapter includes a plate which releasably engages a cleat on a cycling shoe and a disc disposed between said rounded portion and said cleat plate, wherein said disc has a depression on a major surface thereof within which said plate is disposed.

8. The tool of claim 7, wherein said cleat adapter has a first set of apertures therein which align with a second set of apertures in said second major surface of said rounded portion, wherein said cleat adapter is secured in said depression by a set of fasteners, and wherein each member in each set of fasteners extends through one aperture in said first set of apertures and into one aperture in said second set of apertures.

9. The tool of claim 8, wherein each member in each set of fasteners rotatingly engages one aperture in said second set of apertures.

10. The tool of claim 1, wherein said pedal adapter is a cleat.

11. A kit, comprising:

a tool for adjusting the orientation of cycling cleats on cycling shoes, comprising (a) a base plate having a rounded portion with a first protrusion extending therefrom, wherein said first protrusion has a series of indicia thereon, (b) a pedal adapter which is disposed on a first major surface of said rounded portion and which releasably engages a pedal on a bicycle or cycling machine, (c) a cleat adapter, disposed on a second major surface of said rounded portion, which releasably engages a cleat on a cycling shoe, which includes a disc, and which is rotatably adjustable with respect to said rounded portion, wherein said cleat adapter has a depression on a major surface thereof, (d) a second protrusion which protrudes from said cleat adapter and which overlaps said first protrusion, and (e) a handle which protrudes from said cleat adapter, wherein said disc is disposed between said rounded portion and said cleat adapter, wherein said disc has a depression on a major surface thereof within which said cleat adapter is disposed, wherein a relative orientation of the second protrusion with respect to the indicia indicates a present orientation of the cleat with respect to the pedal adapter; and a plurality of keys, wherein each of said plurality of keys releasably engages a different style of cleat, and wherein each of said plurality of keys releasably engages said depression in said cleat adapter.

12. The kit of claim 11, wherein the tool is releasably attachable to a pedal disposed on a device selected from the group consisting of bicycles and cycling machines.

13. The kit of claim 12, further wherein the tool is releasably attachable to a cleat attached to a cycling shoe.

14. The tool of claim 1, wherein said cleat adapter has a first surface thereon which engages said cleat, wherein said pedal adapter has a second surface thereon which engages said pedal, and wherein said first and second surfaces are complimentary in shape.

15. A tool for adjusting the orientation of cycling cleats on cycling shoes, comprising:

a base plate having a rounded portion with a first protrusion extending therefrom, said first protrusion having indicia disposed on a major surface thereof, a pedal adapter which is disposed on a first major surface of said rounded portion and which releasably engages a pedal on a bicycle or cycling machine;

a cleat adapter, disposed on a second major surface of said rounded portion, which releasably engages a cleat on a cycling shoe and which is rotatably adjustable with respect to said rounded portion by way of a handle which extends from said rounded portion radius; and a pointer which protrudes from said cleat adapter and which overlaps said first protrusion, wherein the relative position of the pointer with respect to the indicia indicates the current orientation of the cleat adapter.

* * * * *